US009211006B2

(12) United States Patent
Chen

(10) Patent No.: US 9,211,006 B2
(45) Date of Patent: Dec. 15, 2015

(54) COMBINING STRUCTURE FOR SHELVES

(71) Applicant: Ming-Chi Chen, Taichung (TW)

(72) Inventor: Ming-Chi Chen, Taichung (TW)

( * ) Notice: Subject to any disclaimer, the term of this patent is extended or adjusted under 35 U.S.C. 154(b) by 0 days.

(21) Appl. No.: 14/314,692

(22) Filed: Jun. 25, 2014

(65) Prior Publication Data

US 2015/0001169 A1 Jan. 1, 2015

(30) Foreign Application Priority Data

Jun. 26, 2013 (TW) ..... 102211938 U

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 87/02*** | (2006.01) |

(52) U.S. Cl.

CPC ..... *A47B 87/0223* (2013.01); *A47B 2087/023* (2013.01); *A47B 2087/0238* (2013.01)

(58) Field of Classification Search

CPC . A47B 87/0223; A47B 57/265; A47B 57/545
USPC ..... 211/182, 187, 188, 192; 108/106, 107, 108/110, 147.12–147.17
See application file for complete search history.

(56) References Cited

U.S. PATENT DOCUMENTS

| | | | | | |
|---|---|---|---|---|---|
| 3,263,692 | A * | 8/1966 | Questi et al. | ..... | 135/158 |
| 3,696,763 | A * | 10/1972 | Evans | ..... | 108/157.13 |
| 3,747,965 | A * | 7/1973 | Wing | ..... | 403/173 |
| 3,896,743 | A * | 7/1975 | Pariente | ..... | 108/190 |
| 4,079,678 | A * | 3/1978 | Champagne | ..... | 108/110 |
| 5,035,186 | A * | 7/1991 | Uredat et al. | ..... | 108/159 |
| 5,123,552 | A * | 6/1992 | Aggelen | ..... | 211/194 |
| 5,676,263 | A * | 10/1997 | Chang | ..... | 211/187 |
| 5,957,614 | A * | 9/1999 | Aurich | ..... | 403/170 |
| 6,044,988 | A * | 4/2000 | Yang | ..... | 211/187 |
| 6,062,150 | A * | 5/2000 | Sikora et al. | ..... | 108/190 |
| 6,253,933 | B1 * | 7/2001 | Yang | ..... | 211/187 |
| 6,260,488 | B1 * | 7/2001 | Yang et al. | ..... | 108/107 |
| D485,092 | S * | 1/2004 | Rosen | ..... | D6/465 |
| 7,040,835 | B2 * | 5/2006 | Sun | ..... | 403/383 |
| 8,651,300 | B2 * | 2/2014 | Chen | ..... | 211/187 |
| 2004/0182810 | A1 * | 9/2004 | Rosen | ..... | 211/181.1 |
| 2010/0096352 | A1 * | 4/2010 | Wang | ..... | 211/187 |
| 2011/0036798 | A1 * | 2/2011 | Chen | ..... | 211/188 |
| 2013/0175233 | A1 * | 7/2013 | Wu | ..... | 211/183 |
| 2014/0261107 | A1 * | 9/2014 | Sabounjian | ..... | 108/147.13 |
| 2014/0314470 | A1 * | 10/2014 | Wu | ..... | 403/217 |

* cited by examiner

*Primary Examiner* — Joshua Rodden
*Assistant Examiner* — Kimberley S Wright
(74) *Attorney, Agent, or Firm* — Egbert Law Offices, PLLC

(57) ABSTRACT

A combining structure for shelves has a plurality of bearing portions, connecting rods integrally connected to the periphery of each bearing portion, and each connecting rod extends toward the storage space to form at least one joining end. Multiple vertical supporting tubes are provided having a circumferential wall and two abutting ends, wherein, on the circumferential wall of each vertical supporting tube near the abutting end, at least one avoiding groove is provided. Tubular connectors are provided inside each vertical supporting tube. At least one eccentric socket slot is vertically formed on at least one unilateral position inside each tubular connector, and corresponds to the avoiding groove of the vertical supporting tube, so that the vertical supporting tube can sheathe the joining end of the connecting rod through the eccentric socket slot of the tubular connector, and through the avoiding groove, each vertical supporting tubes can avoid the bearing portion.

6 Claims, 9 Drawing Sheets

COMBINING STRUCTURE FOR SHELVES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a combining structure, and more particularly to an innovatively designed combining structure for shelves.

2. Description of Related Art Including Information Disclosed Under 37 CFR 1.97 and 37 CFR 1.98.

In the structural design of conventional shelves, usually a number of cross bars are combined together (through screw locking or insertion) to form multiple bearing frames. Between the corners of each bearing frame, vertical rods are provided to connect and combine the bearing frames to form a shelf. However, as such a structure has too many complicated joining parts, assembly is not easy and the overall structural strength can not be easily enhanced. Hence the supporting and compressive capacity of the shelf will be affected. This poses a problem and disadvantage.

In view of the above problem and disadvantage, the bearing frames of most shelves in the present market are an integral body to dramatically reduce the joining parts and enhance the shelf assembly easiness and overall structural strength. However, in actual applications, it is found that the combination style of the vertical rods still has some shortcomings to be improved. In most conventional vertical rod combining structures, the corners of each bearing frame are provided with sheathing pieces, so that the vertical rods can be inserted into the corresponding ends of the sheathing pieces. The methods for combination between the vertical rods and the sheathing pieces comprise: tight insertion; fixation with lateral screws on the sheathing pieces after insertion; or male and female clasping, wherein the vertical rods are configured with spaced ring grooves, and corresponding clasping flanges are provided inside the sheathing pieces. However, in any of the above combinations, the outer diameter of each vertical rod must match the inner diameter of the sheathing pieces. This will cause inconvenience in assembly (as the outer diameter of the vertical rods is almost the same as the inner diameter of the sheathing pieces, it will be very difficult to operate during insertion or pulling out because of the tightness), and the material cost of the vertical rods can not be further reduced. This poses a problem and disadvantage. Moreover, the joining parts between each vertical rod will be rough and uneven, affecting the overall appearance of the shelf. Hence, there is a necessity for improvement and breakthrough.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The "combining structure for shelves" disclosed in the present invention features a unique and innovative design wherein it is made up of bearing portions, connecting rods, vertical supporting tubes, tubular connectors and eccentric socket slots and has the following advantages in contrast to prior art: with the avoiding groove provided on the vertical supporting tubes, each vertical supporting tube can avoid the bearing portion during assembly, so that the joining between the vertical supporting tubes can be more smooth, and the shelf has more sense of beauty and value. Moreover, with the structure that the eccentric socket slot is provided on a unilateral position inside the tubular connector, the outer diameter of the connecting rod can be reduced, so that disassembly and assembly become easier. Hence the present invention provides multiple practical benefits of easy disassembly and assembly, nice appearance and added economic value.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
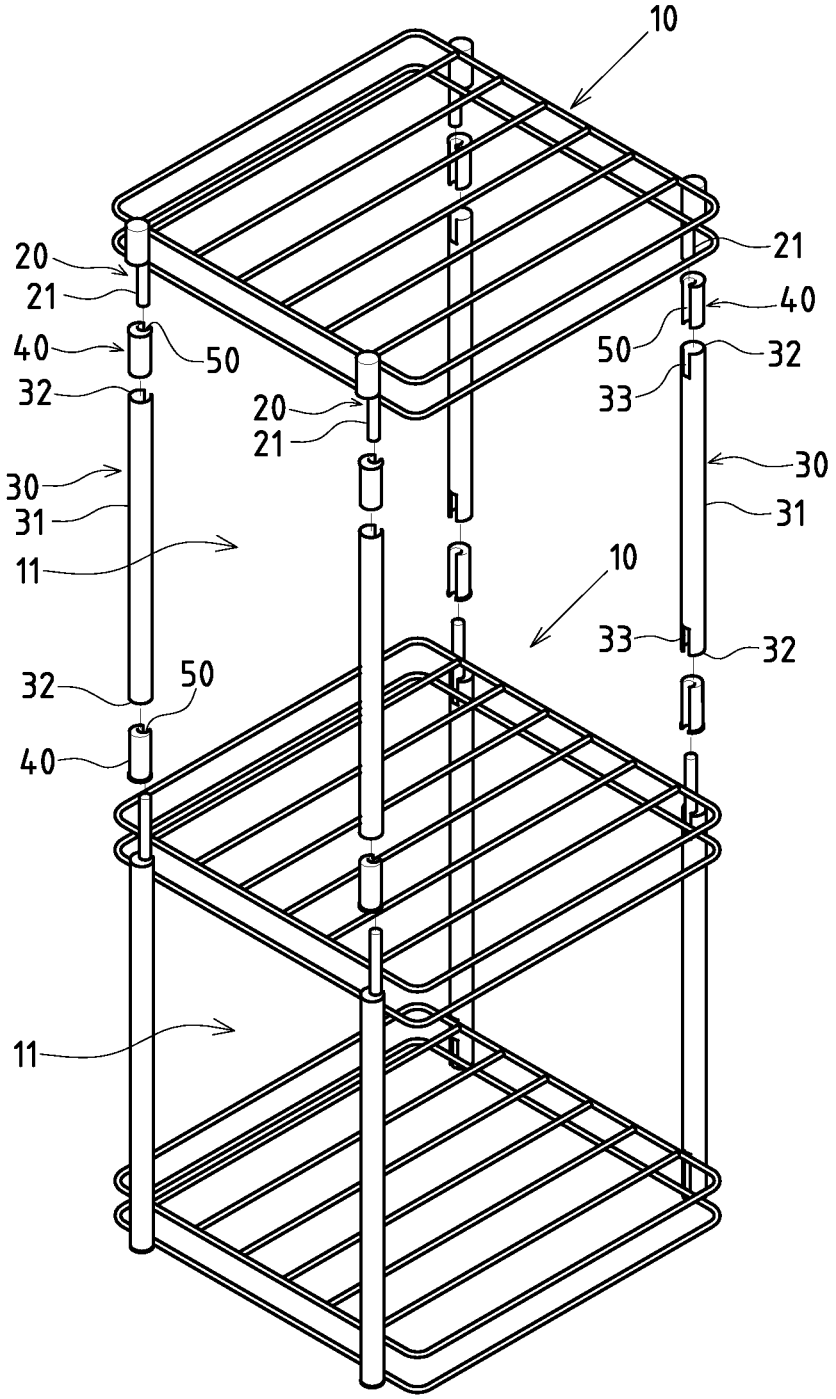
FIG. 1 is an exploded perspective view of the present invention.

FIGS. 1~5 depict a preferred embodiment of the present invention of a combining structure for shelves. While such an embodiment is for description purposes only, it is not intending to limit the scope of patent application.

The combining structure for shelves comprises at least a plurality of bearing portions 10, in the shape of a transverse frame or plate, and the bearing portions 10 are arranged one above the other with some space, so that a storage space 11 is formed between the bearing portions 10.

Multiple connecting rods 20 are integrally connected to the periphery of each bearing portion 10, and each connecting rod 20 extends toward the storage space 11 to form at least one joining end 21.

Multiple vertical supporting tubes 30 are provided in the form of hollow tubes having a circumferential wall 31 and two abutting ends 32, wherein, on the circumferential wall 31 of each vertical supporting tube 30 near the abutting end 32, at least one avoiding groove 33 is provided. In implementation, said vertical supporting tubes 30 can be made of a round, oval, square or polygon tube integrally formed through extrusion. And not limited to the above, other types like triangular tubes can also be adopted by the present invention.

Multiple tubular connectors 40 are provided inside each vertical supporting tube 30. In implementation, said tubular connectors 40 can be inserted into each vertical supporting tube 30 in a detachable style, or fixed inside the vertical supporting tube 30 in a non-detachable style. This part has no limitation.

At least one eccentric socket slot 50 is vertically formed on at least one unilateral position inside each tubular connector 40, and corresponding to the avoiding groove 33 of the vertical supporting tube 30, so that the vertical supporting tube 30 can sheathe the joining end 21 of the connecting rod 20 through the eccentric socket slot 50 of the tubular connector 40, and through the avoiding groove 33, each vertical supporting tubes 30 can avoid the bearing portion 10. The sectional shape of the eccentric socket slot 50 can be any of a round, oval, square or polygon shape, and correspondingly, the connecting rod 20 connected to the bearing portion 10 can be any of a round, oval, square or polygon shape to match the eccentric socket slot 50. In the present embodiment, the eccentric socket slot 50 and the connecting rod 20 are in a round shape as an example. In particular, in actual implementation, the eccentric socket slot 50 can vertically go from the top through to the bottom of the tubular connectors 40, or only go through the top or bottom of the tubular connectors 40. This part has no limitation.

Based on the above structural design, when the vertical supporting tube 30 sheathes the joining end 21 of the connecting rod 20, through the avoiding groove 33, each vertical supporting tube 30 can avoid the bearing portion 10, so that the joining between the vertical supporting tubes 30 can be more smooth, i.e., the bearing portion 10 will not contact and interfere with the abutting end 32 of the vertical supporting tubes 30. Hence, during assembly, it can avoid the situation wherein the vertical supporting tubes 30 is separated because of the height of the bearing portion 10 itself, leading to a separated space between the abutting ends 32 of the vertical supporting tubes 30, which reduces the beauty of the product. The present invention provides more sense of beauty and value. On the other hand, in the present invention, as the eccentric socket slot 50 is provided on a unilateral position inside the tubular connector 40, it can further reduce the outer diameter of the connecting rod 20, so that disassembly and assembly become easier. The present invention can effective overcome the operational difficulty during insertion, pulling-out or clamping because of the tightness caused by the fact that the outer diameter of conventional vertical rods are almost the same as the inner diameter of the sheathing pieces. Hence the present invention provides multiple practical benefits of easy disassembly and assembly, nice appearance and added economic value.

Below is a description of possible embodiments of the present invention.

Referring to FIG. 1, the connecting rod 20 provided on the topmost bearing portion 10 is in a downward protruding shape, while the connecting rod 20 provided on the bottom-most bearing portion 10 is in an upward protruding shape, and the connecting rod 20 provided on middle-layer bearing portion 10 is in a relatively upward and downward protruding shape, so that the vertical supporting tubes 30 are sheathed between the connecting rods 20 through the tubular connectors 40, and each bearing portion 10 obtains support and resistance to pressure.

Figure 2:
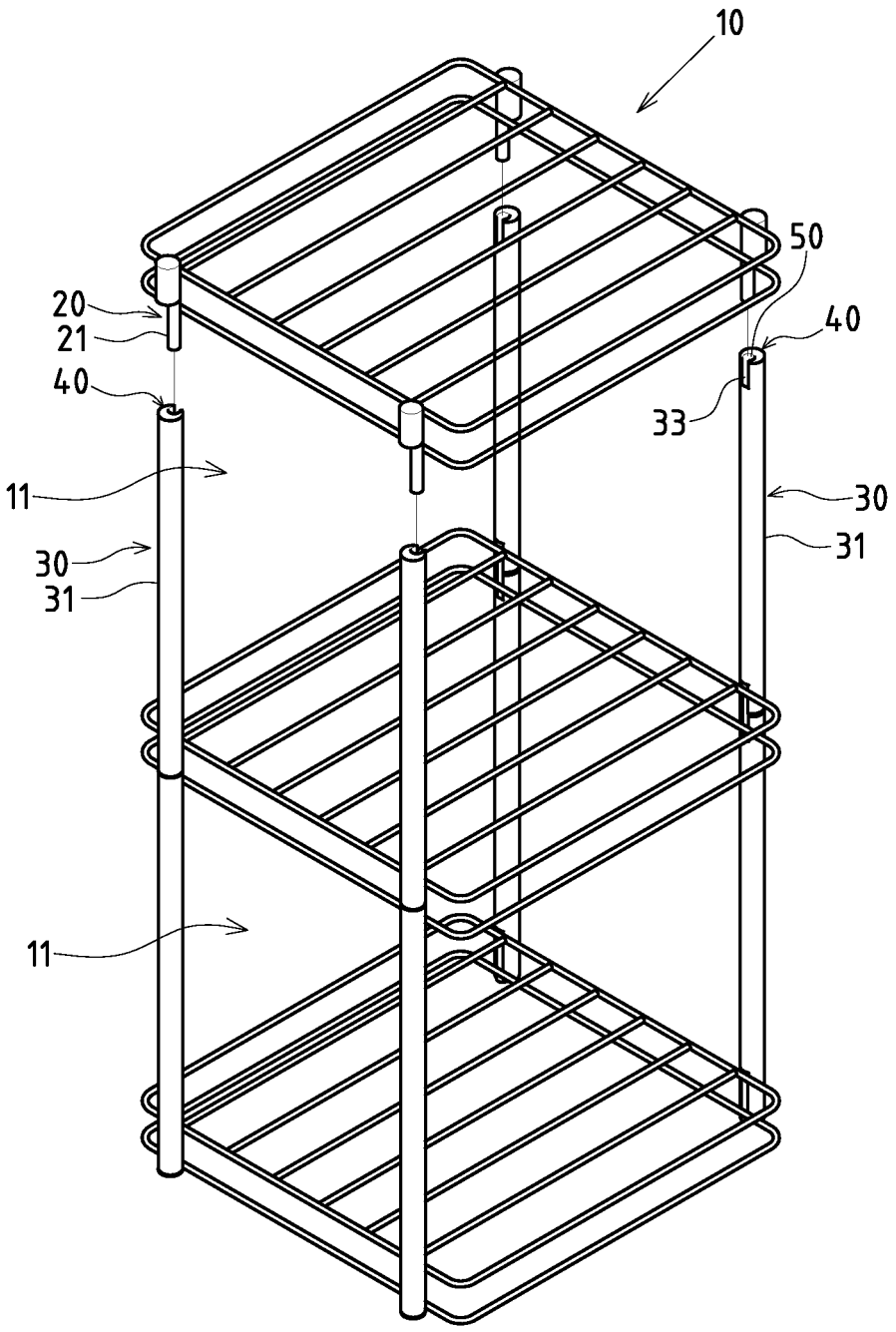
FIG. 2 is a perspective view of the present invention with the vertical supporting tubes separated from the connecting rod of the bearing portion.
Figure 3:
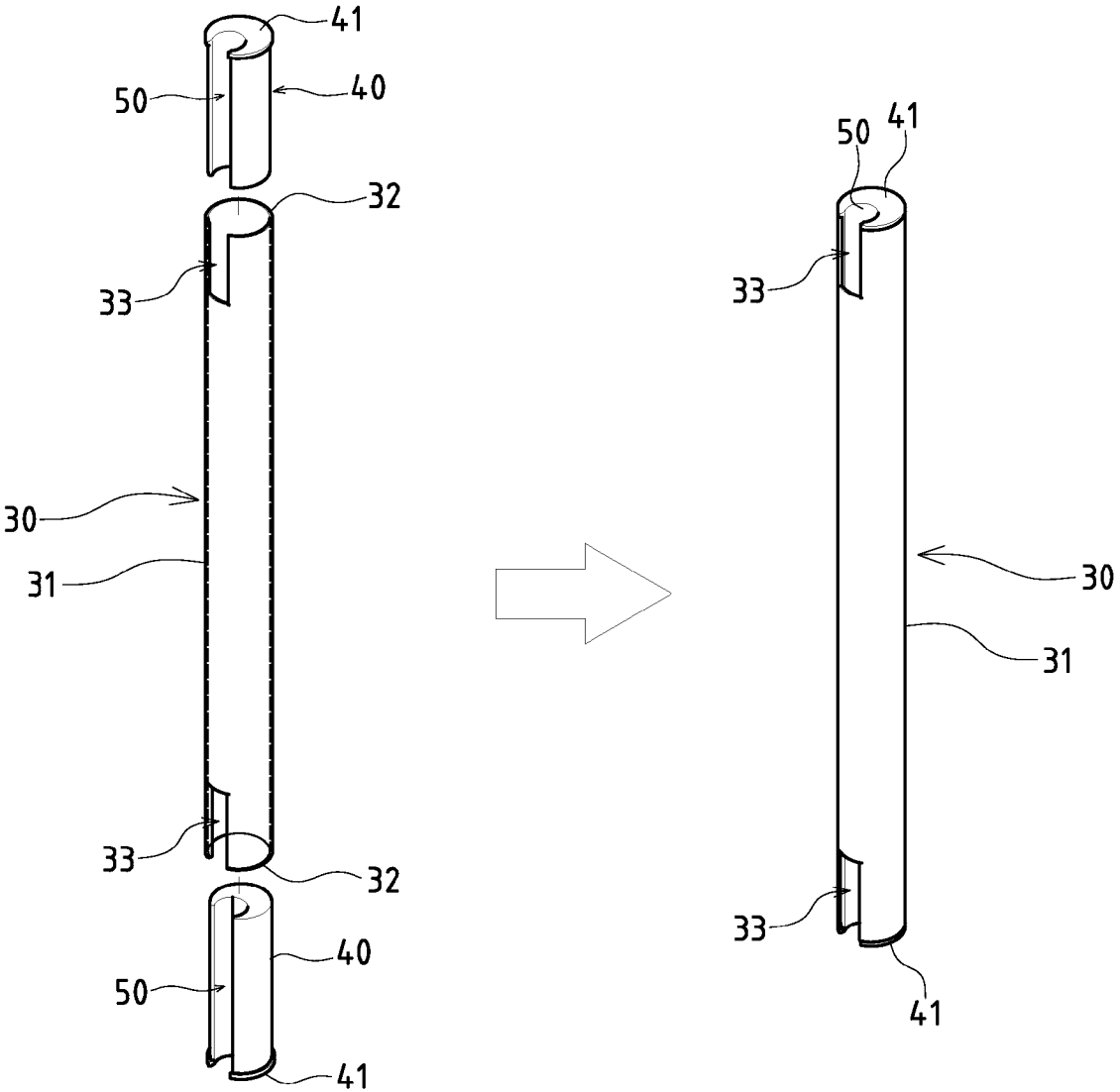
FIG. 3 is a combination status view of the present invention showing combination between the vertical supporting tube and the tubular connector.
Figure 4:
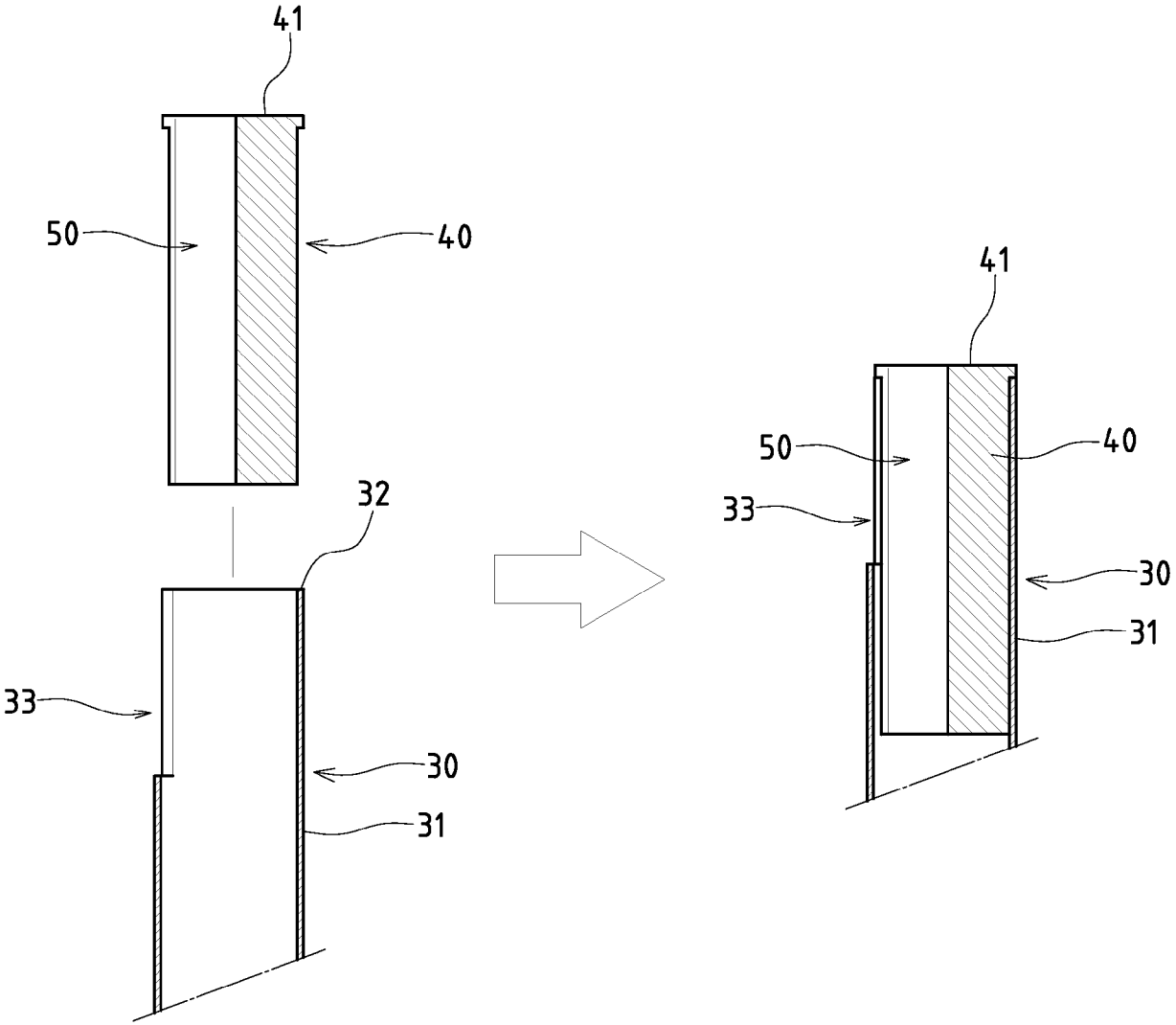
FIG. 4 is a sectional view of the combination between the vertical supporting tube and the tubular connector of the present invention.
Figure 5:
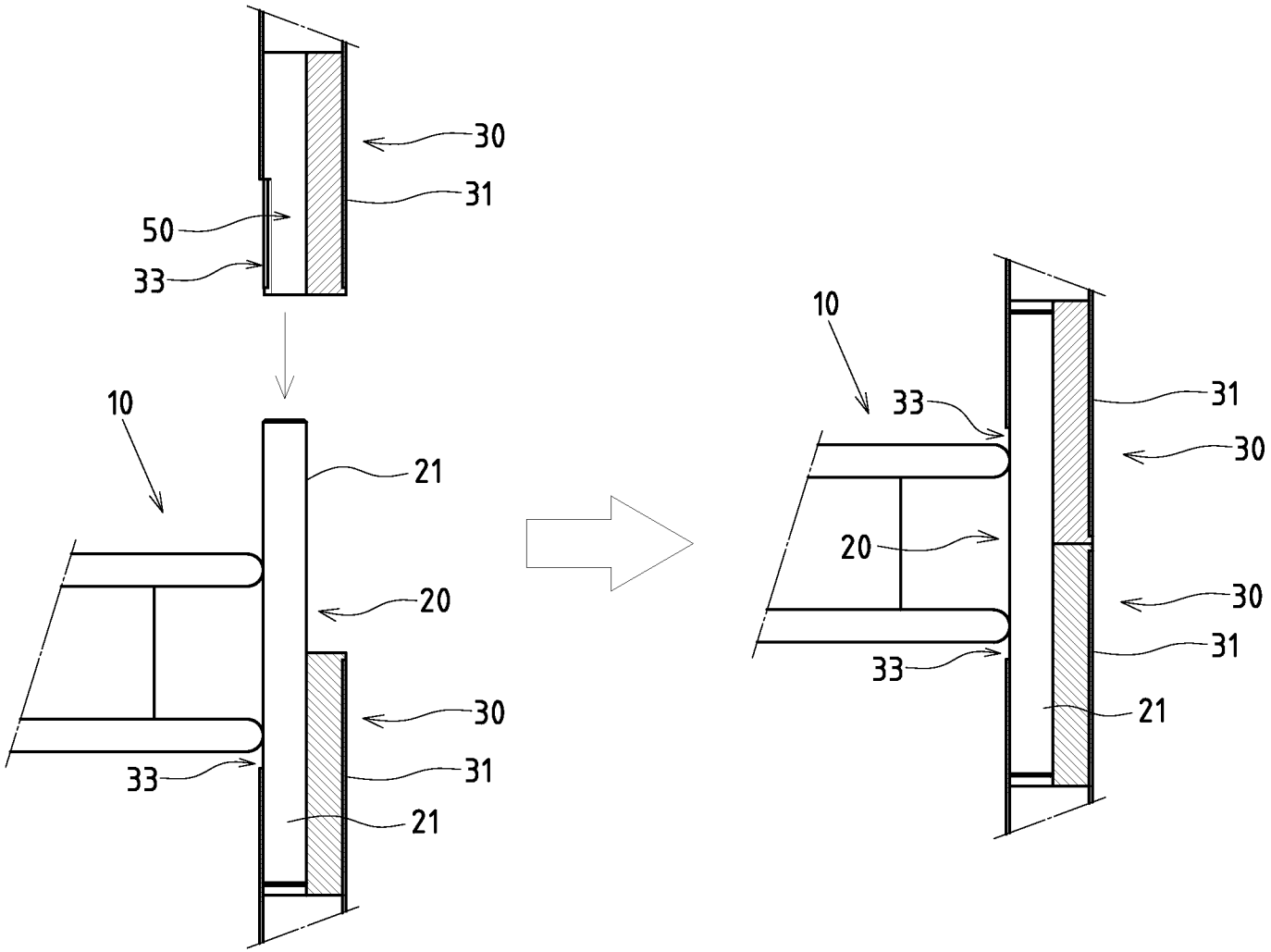
FIG. 5 is a status view of the present invention with the vertical supporting tube joined with the connecting rod.

Referring to FIG. 2, one end of the tubular connector 40 can be configured with a diameter expansion to form an expanding edge 41, so that when the tubular connector 40 is fixed inside the vertical supporting tube 30, it can be propped on the abutting end 32 of the vertical supporting tube 30 through the expanding edge 41 and be fixed and limited; or, the tubular connectors 40 can be a straight tube, and it is fixed and limited through the friction and tight contact between its own outer diameter and the internal wall of the vertical supporting tube 30. This part has no limitation.

Figure 6:
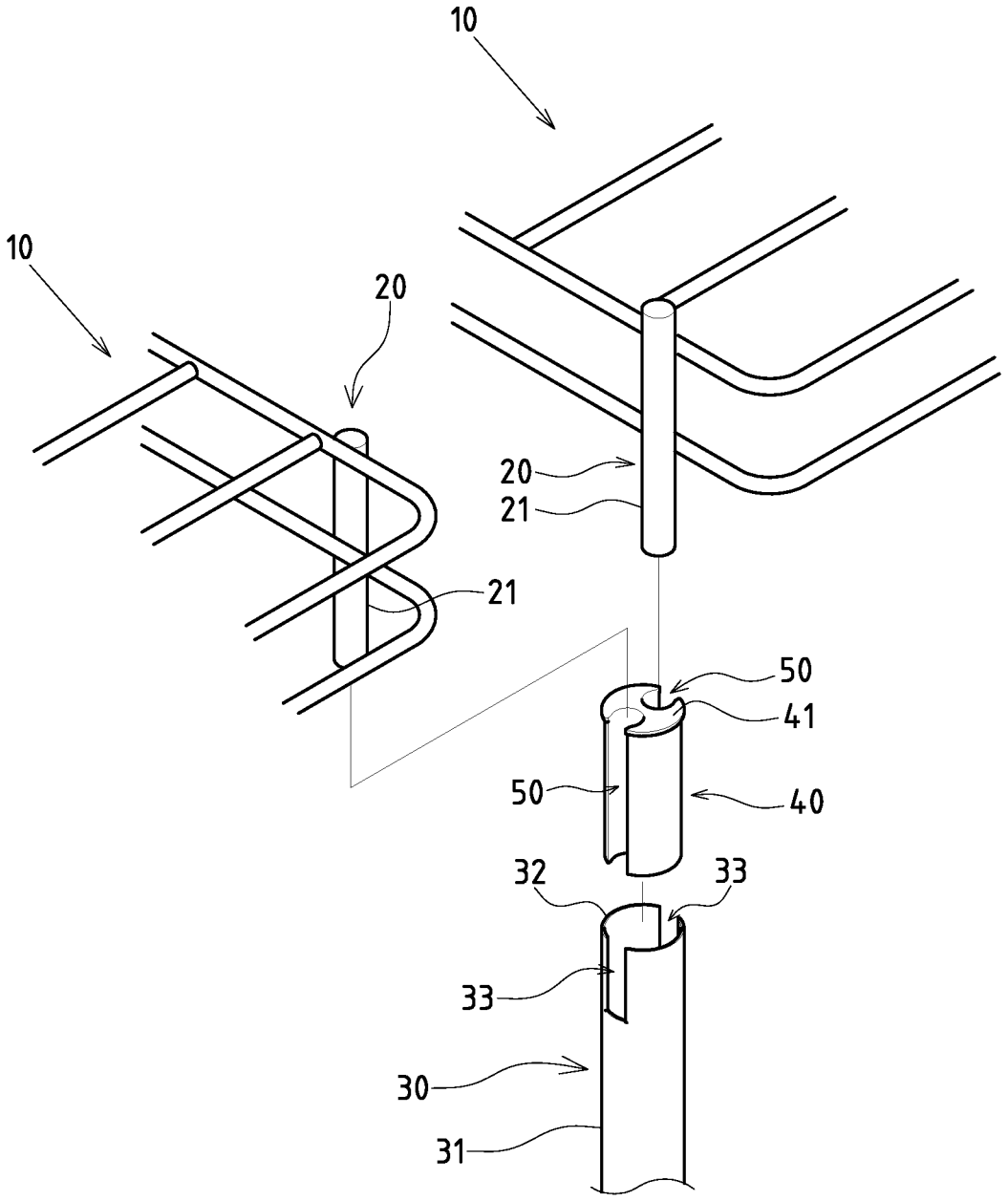
FIG. 6 is a perspective view of an embodiment of the present invention with the two relative sides of the tubular connector both formed with eccentric socket slots.

Referring to FIG. 6, the eccentric socket slot 50 can be formed on two relative unilateral sides inside the tubular connector 40, so that the connecting rods 20 of the bearing portions 10 can be inserted transversely side by side into the eccentric socket slot 50 and the shelf can be transversely expanded.

Figure 7:
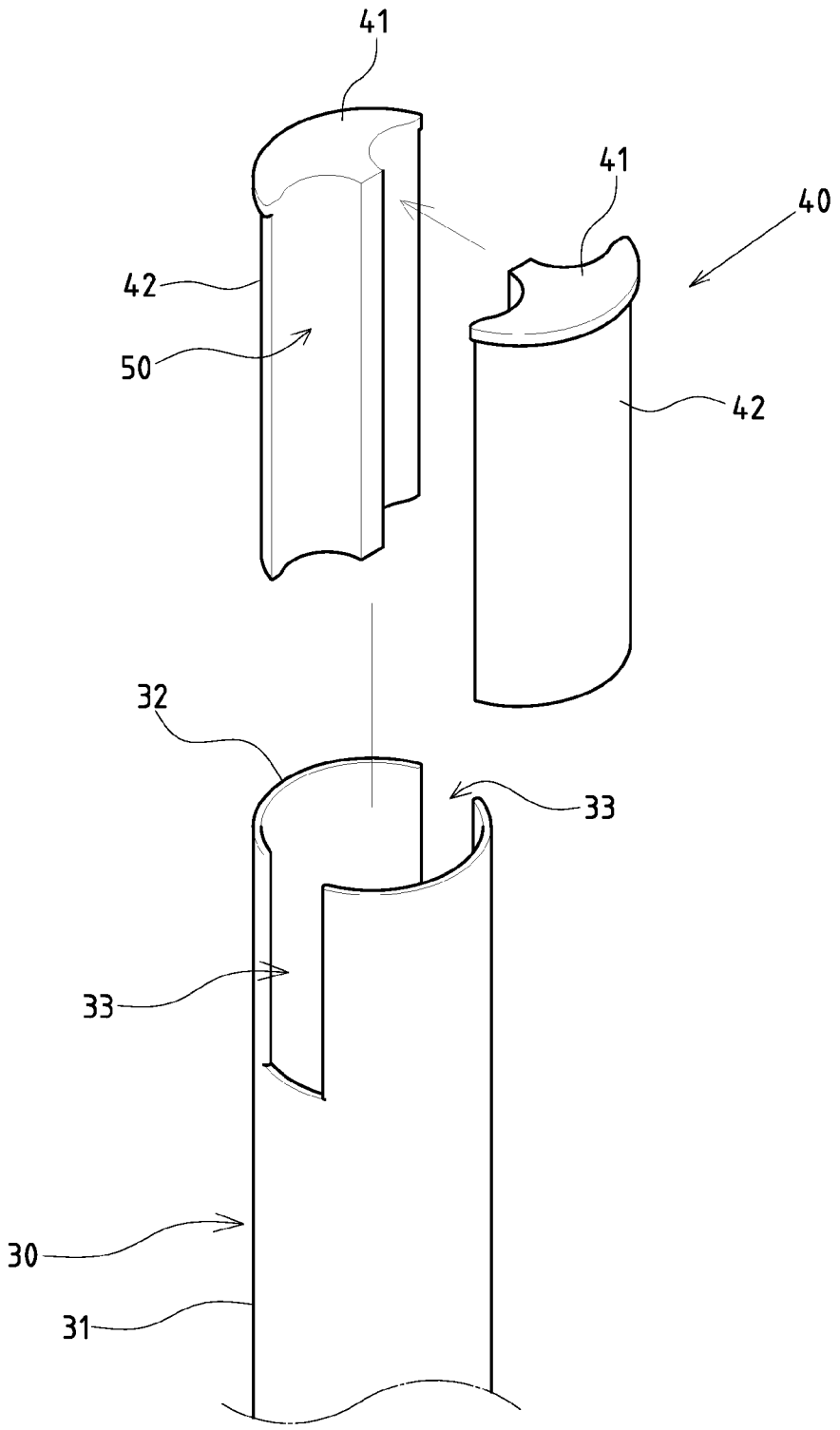
FIG. 7 is a perspective view of the present invention with the tubular connector being a two-piece structure made up of two semi-circular components.

As shown in FIG. 7, the tubular connector 40 is a two-piece structure made up of two semi-circular components 42, or, as shown in FIG. 6, it is an integrally formed structure. This part has no limitation. In particular, when the tubular connector 40 is a two-piece structure made up of two semi-circular components 42, the two semi-circular components 42 can be connected to each other through clasping, so that during assembly the two semi-circular components 42 can be clasped and then sheathed on the joining end 21 of the connecting rod 20 provided on the bearing portion 10, and then the vertical supporting tube 30 is sheathed outside the two semi-circular components 42, Or, the two semi-circular components 42 can be directly inserted into the vertical supporting tube 30, and then the vertical supporting tube 30 is sheathed on the connecting rod 20. The above methods of assembly have no limitation. Any method can be selected based on the situation of assembly.

Figure 8:
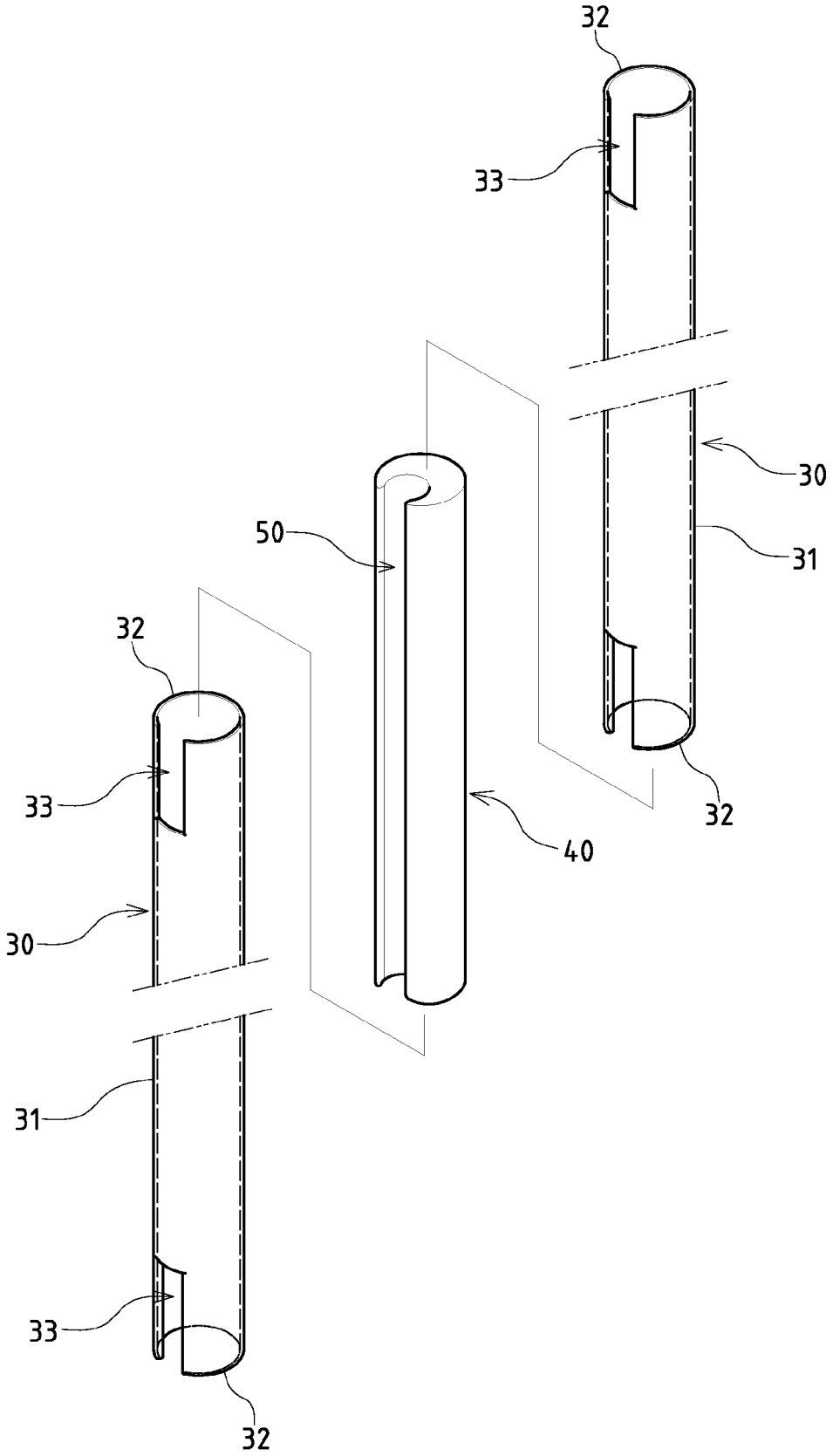
FIG. 8 is a perspective view of the present invention with the tubular connector in the shape of a long tube.

As shown in FIG. 8, in implementation, the tubular connector 40 can also be configured as a long extending tube, so that the two ends of the tubular connector 40 can be inserted into different vertical supporting tubes 30. During assembly, the tubular connector 40 can also be firstly sheathed on the joining end 21 of the connecting rod 20 provided on the bearing portion 10, and then the vertical supporting tube 30 is sheathed outside the tubular connector 40, or, the tubular connector 40 is directly inserted into the vertical supporting tube 30, and then the vertical supporting tube 30 is sheathed on the connecting rod 20. This part has no limitation.

Figure 9:
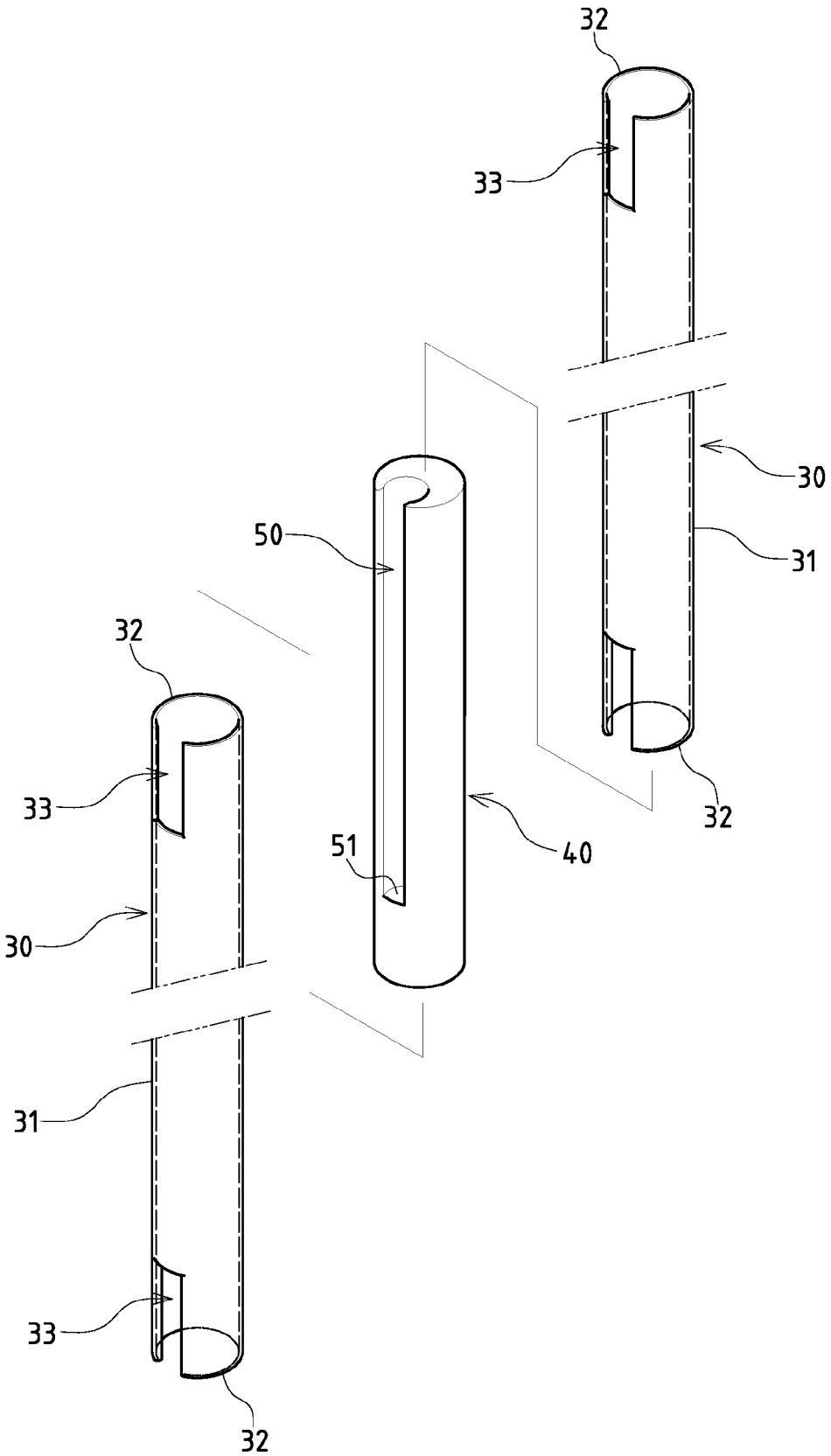
FIG. 9 is a perspective view of another embodiment of the tubular connector of the present invention.

Furthermore, as shown in FIG. 8, the eccentric socket slot 50 can vertically go from the top through to the bottom of the tubular connector 40, or as shown in FIG. 9, the eccentric socket slot 50 only vertically goes through the top of the tubular connector 40, and the end different to the through position is formed with an abutting wall 51, so that when the tubular connector 40 is firstly sheathed on the joining end 21 of the connecting rod 20, the joining end 21 of the connecting rod 20 can be propped on the abutting wall 51. Therefore, when the tubular connector 40 is inserted into the vertical supporting tube 30, when the joining end 21 of the connecting rod 20 pushes against the abutting wall 51, it will simultaneously drive the tubular connectors 40, so that the tubular connector 40 can be reliably inserted into the vertical supporting tube 30, and assembly becomes easier for the user.

I claim:

1. A shelving apparatus comprising:

a plurality of bearing portions arranged one above another so as to define a storage space therebetween, each of said plurality of bearing portions being a frame or a plate extending horizontally;

a plurality of connecting rods integrally connected to a periphery of the bearing portion, each of said plurality of connecting rods extending toward the storage space, each of said plurality of connecting rods having a joining end;

a plurality of vertical supporting tubes each having a circumferential wall and a pair of abutting ends, each of said plurality of vertical supporting tubes having a shape of a hollow tube, at least one avoiding groove being formed on the circumferential wall adjacent the abutting end;

a plurality of tubular connectors respectively received within said plurality of vertical supporting tubes, each of said plurality of tubular connectors having an eccentric socket slot vertically formed at a unilateral position within the tubular connector so as to align with and correspond to the avoiding groove of the vertical supporting tube such that the vertical supporting tube sheaths the joining end of the connecting rod through the eccentric socket slot of the tubular connector through the avoiding groove such that each of the vertical supporting tubes avoids the bearing portion, said plurality of vertical supporting tubes having an upper supporting tube having a lower end directly abutting an upper end of a lower supporting tube such that the connecting rod is concealed in an interior of the upper and lower support tubes, the tubular connector having one end with an expanded diameter so as to define an expanded edge, the tubular connector being propped on the abutting end of the vertical supporting tube via the expanded edge.

2. The shelving apparatus of claim 1, the eccentric socket slot being formed on two sides within the tubular connector.

3. The shelving apparatus of claim 1, the tubular connector being integrally formed.

4. The shelving apparatus of claim 1, the tubular connector being a two-piece structure.

5. The shelving apparatus of claim 1, the tubular connector being an elongated tube.

6. A shelving apparatus comprising:

a plurality of bearing portions arranged one above another so as to define a storage space therebetween, each of said plurality of bearing portions being a frame or a plate extending horizontally;

a plurality of connecting rods integrally connected to a periphery of the bearing portion, each of said plurality of connecting rods extending toward the storage space, each of said plurality of connecting rods having a joining end;

a plurality of vertical supporting tubes each having a circumferential wall and a pair of abutting ends, each of said plurality of vertical supporting tubes having a shape of a hollow tube, at least one avoiding groove being formed on the circumferential wall adjacent the abutting end; and a plurality of tubular connectors respectively received within said plurality of vertical supporting tubes, each of said plurality of tubular connectors having an eccentric socket slot vertically formed at a unilateral position within the tubular connector so as to align with and correspond to the avoiding groove of the vertical supporting tube such that the vertical supporting tube sheaths the joining end of the connecting rod through the eccentric socket slot of the tubular connector through the avoiding groove such that each of the vertical supporting tubes avoids the bearing portion, said plurality of vertical supporting tubes having an upper supporting tube having a lower end directly abutting an upper end of a lower supporting tube such that the connecting rod is concealed in an interior of the upper and lower support tubes, the eccentric socket slot extending from a top to a bottom of the tubular connector.

* * * * *